United States Patent [19]

Fuller

[11] Patent Number: 4,867,214

[45] Date of Patent: Sep. 19, 1989

[54] DUAL FUNCTION JACKET FOR BOTTLE-SHAPED CONTAINERS

[75] Inventor: David G. Fuller, Prince George, Canada

[73] Assignee: Vintage Vestments International, Inc., Victoria, Canada

[21] Appl. No.: 109,519

[22] Filed: Oct. 19, 1987

[51] Int. Cl.[4] ..... B32B 1/08

[52] U.S. Cl. ..... 428/35.8; 428/4; 428/7; 220/903; D9/444

[58] Field of Search ..... 428/7; 220/903; 150/52 R; D9/444, 319

[56] References Cited

U.S. PATENT DOCUMENTS

| | | | |
|---|---|---|---|
| D. 163,888 | 7/1951 | Merillat | D9/444 |
| D. 211,565 | 7/1968 | Crump | D9/444 |
| 2,035,384 | 3/1936 | Hinchliff | 220/903 X |
| 4,197,890 | 4/1980 | Simko | 150/52 R X |
| 4,282,279 | 8/1981 | Strickland | 220/903 X |
| 4,401,245 | 8/1983 | Zills | 220/903 X |

*Primary Examiner*—Alexander S. Thomas

*Attorney, Agent, or Firm*—Robert L. Harrington

[57] ABSTRACT

An insulator-decorative cover for a wine bottle that includes an inner layer of thin flexible insulation that substantially covers the side surface area of the bottle excepting a neck portion through which the pour spout projects. An outer cover is decoratively designed to simulate; e.g. a tuxedo or other festive clothing associated with wine.

1 Claim, 1 Drawing Sheet

DUAL FUNCTION JACKET FOR BOTTLE-SHAPED CONTAINERS

FIELD OF INVENTION

This invention relates to a jacket for a beverage container and more particularly, a cover functioning to both insulate and decorate the beverage container.

BACKGROUND OF THE INVENTION

It is preferable to drink wine at a specific temperature. Wine that is preferably chilled or cooled below room temperature, will become undesirably warmed in a short period of time if left to stand at room temperature. For example, a white dinner wine served to the dinner table at the start of a meal, will warm during the period of the meal. Thus the glasses of wine served during and after the meal will not be served at the same temperature or taste with which it started.

Wine may be served in an ice bucket. However, the ice bucket doesn't necessarily maintain the desired temperature. It is also cumbersome in a lot of situations. Athough perhaps common in fine restaurants, that is not the case in the home or in restaurants in general. More often, the wine is simply served to the table and allowed to warm. This is not preferable, but simply a matter of weighing conveniences.

BRIEF SUMMARY OF THE INVENTION

The present invention provides the benefit of an insulator for a wine bottle while also providing decoration that can be amusing or attractive, thus adding to the atmosphere and enjoyment of a meal.

In brief, the insulating jacket includes a thin cover of flexible insulation such as is now available as a result of developments in the aerospace industry (as insulation for space suits). One such material is sold under the trademark "Radian Tex" available from the Texel Corporation of Boyce, Quebec, Ontario, Canada. The cover is configured with a body portion and neck portion. The body portion drapes over the body of the wine bottle and the neck portion that runs up the neck of the bottle but having an opening through which the pour spout projects.

Surrounding the insulation is an overcover that is provided for decoration. It is of a decorative cloth material that is fashioned, preferably, into a piece of clothing; e.g. resembling a tuxedo or other formal dress that "fits" the occasion. The combination provides a unique bottle jacket that is highly effective an an insulator so as to maintain the temperature of a liquid; e.g. wine, contained in the bottle. It is also an attractive cover that provides table decoration.

The invention will be further appreciated upon reference to the following detailed description and drawings wherein.

Figure 1:
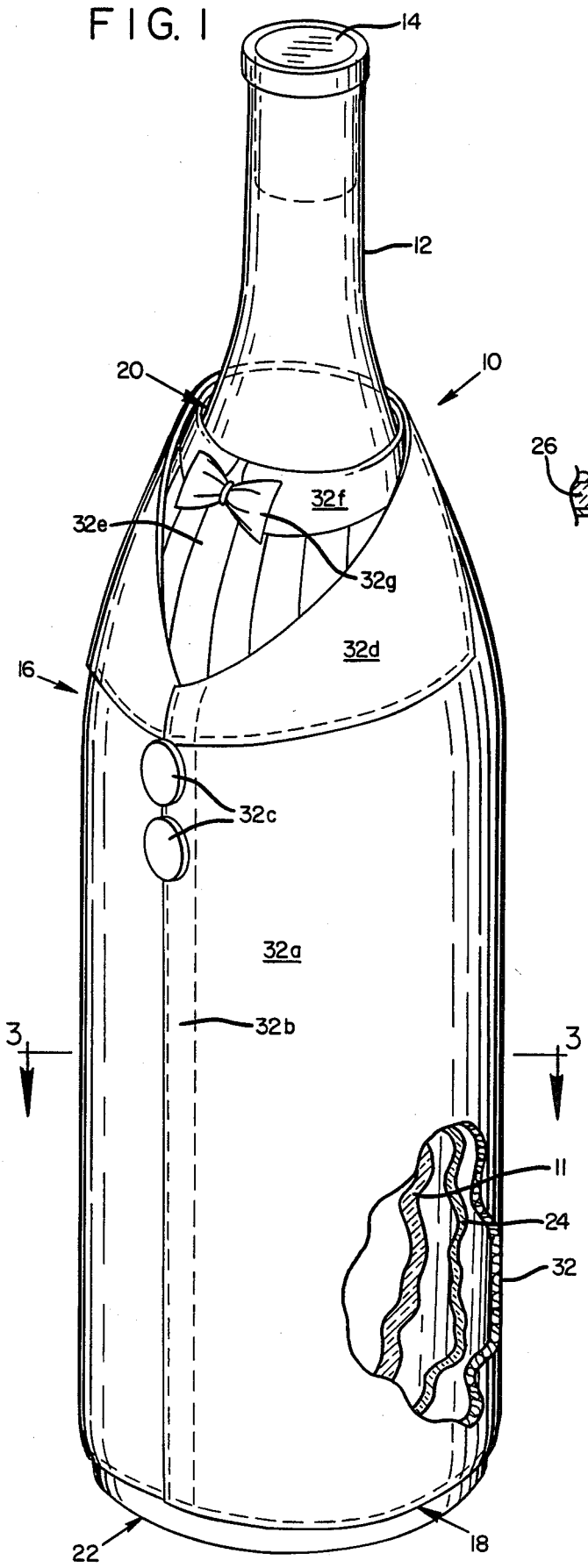
FIG. 1 is a perspective view of a bottle and jacket in accordance with the present invention.
Figure 2:
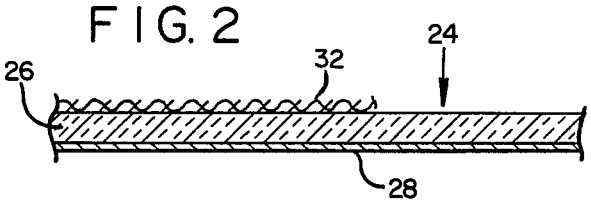
FIG. 2 is a section view of the material of the insulation cover incorporated into the jacket of FIG. 1.
Figure 3:
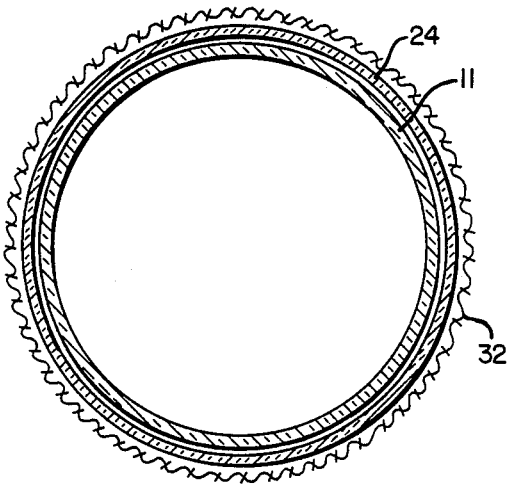
FIG. 3 is a section view as taken on section lines 3—3 of FIG. 1.

With reference to the Figures, a covered wine bottle 10 contains wine (not shown) that has been pre-chilled. The bottle itself is of conventional configuration having a straight tubular portion 11 that contains the principal portion of the wine. The top of the bottle above the tubular portion closes to form a neck portion 12. The closed bottom of the bottle is indicated by reference number 22. An opening in the top of the neck portion emables the wine to be poured. As illustrated, the opening is closed by a cork 14.

A jacket 16 is provided over the bottle and has a bottom opening 18 and a top opening 20 that allows the jacket to be slipped over the neck portion and down the bottle sides to substantially cover the entire tubular portion as well as much of the neck portion.

There are two functions that the jacket 16 provides. One is to insulate the bottle to substantially maintain the temperature of the wine contained in the bottle over a period of time. With the jacket substantially enclosing the entire bottle's surface except the small neck portion 12 and bottom 22, the wine temperature will change very little over a period of several hours. Such a gradual change in temperature is generally inperceptible to a wine fancier over the normal period of a fine dinner.

The insulation for the jacket 16 is provided by a thin layer 24. The insulation layer 24 is composed of polyester inner core 26 and a moisture barrier 28 on the inside. As previously mentioned, this insulation layer 24 is a product of space technology, developed as insulation for spacesuits. A one-eighth inch thick layer is very effective in providing the desired temperature control. It is very flexible and is readily shaped into a bottle cover as illustrated. The material of cover 24 is produced by Texel Corporation of Boyce, Quebec. The product is sold under the trademark "Radian Tex". It can be appreciated that cover 24 is desirably an integral cover that can be handled independently of the overcover 32 (to be explained). Overcover 32 is required to have two characteristics. It is required to be flexible,. and it is required to be decorative.

Because the insulation cover 24 is cloth-like in nature, any of a wide range of cloth materials can be sewn to the cover 24. Thus the layer 24, as illustrated, becomes a liner for the overcover 32. In the illustrated embodiment, the overcover 32 is designed to resemble a tuxedo. Thus section **32*a* forms the body of a tuxedo, with a seam 32*b* provided to resemble the tuxedo jacket front. 32*c* is the jacket buttons, 32*d* is the jacket lapel, 32*e* is the formal shirt with collar 32*f*, and 32*g* the formal bow tie. The neck 12 of the bottle thus simulates a human neck protruded from a tuxedo jacket. The overcover 32 is preferably made independent of the cover 24, and when completed, simply stiched or sewn to the insulation cover 24**.

The design of the overcover 32 is not so important as the fact that it is designed to accommodate the occasion. A tuxedo or wedding dress may be appropriate for a wedding party (to cover a champagne bottle), an Italian dress for wine with pizza, and so on.

The two-piece cloth-like materials can be folded and readily stored, and then readily retrieved for covering a fine or not-so-fine bottle of wine. The flexibility enables the wine host to securely grip the bottle for pouring. When one bottle is consumed, another can be insulated simply by slipping the jacket off the old and applying it to the new.

The invention is considered simple, yet unique and effective. Others will undoubtedly conceive of numerous variations which are contemplated herein as defined in the claims appended hereto.

I claim:

1. An insulating and decorative jacket for bottle-shaped containers having a bottle neck and body comprising;

a flexible insulating under cover, said insulating under cover is non-woven polyester fibers needled through a metallized film, the under cover is constructed to fit closely around the container body with an open bottom and an open top reduced in dimension relative to the open bottom through which the neck of the container protrudes, an integral over cover of cloth material constructed to mate with the under cover and decoratively designed to be coordinated with the container body and neck to resemble a garment being worn by a person, said garment being representative of a festive occasion, and said insulating under cover and over cover sewn together with the under cover being attached as a liner inside the over cover to provide a jacket having a combination of covers with distinct, separable functions for insulating the contents of the container and providing a table ornament suggestive of a festive occasion.

* * * * *